US005180614A

United States Patent [19]

Escabasse

[11] Patent Number: 5,180,614

[45] Date of Patent: Jan. 19, 1993

[54] SUPPLE SHEET, RESISTANT TO TEARING AND BURSTING, WITH POOR LIQUID-ABSORBING POWER AND CONTROLLED POROSITY

[75] Inventor: Jean-Yves Escabasse, Charavines, France

[73] Assignee: Arjomari Europe, Paris, France

[21] Appl. No.: 469,391

[22] Filed: Jan. 24, 1990

[30] Foreign Application Priority Data

Dec. 22, 1989 [FR] France ..... 89 17147

[51] Int. Cl.[5] ..... B29D 22/00

[52] U.S. Cl. ..... 428/34.2; 428/288; 428/290; 428/320.2; 428/327; 428/338; 428/342; 428/339; 428/326; 427/411; 106/210; 106/197.1; 106/238; 162/134; 162/106; 206/363; 8/120

[58] Field of Search ..... 428/34.2, 326, 338, 428/339, 320.2, 327, 342, 288, 289, 290; 427/411; 106/210, 238, 197.1; 162/134, 136; 206/363; 8/120

[56] References Cited

U.S. PATENT DOCUMENTS

| | | | |
|---|---|---|---|
| 2,268,674 | 1/1942 | Roth | 106/287 |
| 3,916,058 | 10/1975 | Vossos | 428/241 |
| 4,025,354 | 5/1977 | Emerson et al. | 106/218 |
| 4,207,367 | 10/1980 | Baker, Jr. | 428/290 |
| 4,235,657 | 11/1980 | Greenman et al. | 156/234 |
| 4,247,318 | 1/1981 | Lee et al. | 156/163 |
| 4,430,380 | 2/1984 | Hönel et al. | 428/254 |
| 4,597,218 | 7/1986 | Friemel et al. | 428/290 |
| 4,968,774 | 11/1990 | Didier et al. | 428/290 |

FOREIGN PATENT DOCUMENTS 908866 10/1962 United Kingdom .

*Primary Examiner*—Ellis P. Robinson
*Assistant Examiner*—J. Weddington
*Attorney, Agent, or Firm*—Bacon & Thomas

[57] ABSTRACT

The supple sheet according to the invention, which is resistant to tearing and bursting, has a low water- or other liquid-absorbing power, controlled porosity and is printable, comprises:

at least cellulosic fibers, optionally synthetic fibers, at least one binder, at least one moisture-retaining agent in a proportion less than about 20% by dry weight of the sheet, at least one sizing agent.

The invention finds an application in sterilizable packages.

7 Claims, No Drawings

SUPPLE SHEET, RESISTANT TO TEARING AND BURSTING, WITH POOR LIQUID-ABSORBING POWER AND CONTROLLED POROSITY

The present invention relates to a supple sheet, particularly suitable for use in sterilizable packagings.

BACKGROUND OF THE INVENTION

Supple sheets are already known and used for packaging, for example, surgical equipment, probes, scalpels, clamps, and any other equipment used by doctors and/or surgeons.

Such supple sheets are required to have, simultaneously and necessarily, definite properties.

The first property is that the sheet must be supple in order to form bags designed to receive objects of various sizes and shapes.

The second property is that the sheet must be resistant to tearing as well as to bursting, as indeed, it is designed to contain objects which may be heavy and blunt or sharp. It should also be able to withstand, as a bag, during sterilization with gases such as ethylene oxide, a pressure when the gases are injected, and subsequently a strong depression during exhaust of the gases which must be total.

The third property is that the sheet must have a low power of absorption towards water, so that the water or any other liquid products cannot penetrate inwardly from the outside through the bag formed by the sheet, and soil the object contained therein.

The fourth property is that the sheet must be permeable to gases. Indeed, when the object has been introduced into the bag and said bag has been sealed, the whole is subjected to the action of sterilizing gases and/or of sterilizing ionic radiations. However, it is important that such permeability be low enough to prevent bacteria or other micro-organisms from penetrating into the bag.

It is already known, for example for forming packages for surgical tools, to use sheets which are constituted of papers obtained by the wet process, by draining an aqueous suspension of cellulose fibers on a wire (Foudrinier process) and drying the sheet.

Such paper sheets are sold to manufacturers of sterilizable bags or packages who form the bag by depositing a bonding layer of varnish between the edges of the sheet and a transparent film.

Other converting techniques use a heat-sealable lacquer in aqueous or solvent medium, permitting to the paper to retain a certain gas-permeability. The bags or pouches are then produced by heat sealing with plastic films.

One drawback with these papers is that, generally, they lack suppleness and are moderately resistant to tearing and bursting.

Said papers have a low water- or other liquids-absorbing power, due to the introduction, at the production stage, either in the aqueous suspension, or by surface treatment, of a bonding agent, which may be neutral, for example of dimeric ketene type which reduces water absorption through the sheet.

The aim of the prior art has therefore been to improve the physical strength of the sheet, and more particularly its resistance to tearing and bursting. To this effect, attempts have been made to increase the bond between the cellulosic fibers. To do this, a binding agent of polyvinyl alcohol type has been introduced by coating the sheet with a composition containing said polyvinyl alcohol. However, one disadvantage with this mechanically resistant paper for sterilizing is that the introduction of the binder gives it too much stiffness, resulting in an unaesthetic appearance of the final package caused by the presence of creases which are due to the fact that the package does not adequately adopt the shape of the packed objects.

Other sheets of paper are known which are made more resistant to tearing and bursting by mass and/or surface introduction of, for example acrylic latex of polymers. The lack of suppleness of the sheet of paper may cause opening of the seals during handling of the finished packages. Said sheets are produced and sold by the company KIMBERLEY CLARK. They are supple and have a plastic feel. They are, however, difficult and expensive to produce and give a paper of non-homogeneous properties. Furthermore, the paper is relatively permanent and much less biodegradable than a normal paper. Said papers are not very water-repellent as they are of low sizing.

Other known sheets of paper are treated with sorbitol in a size-press to make them supple. The problem arising with such sheets is that their resistance to tearing and to bursting is relatively poor and that sizing is difficult to obtain.

Non-woven dry type sheets have also been produced, the method consisting in producing a mat of synthetic fibers, such as polyethylene fibers, by thermobonding the fibers together. Said sheets are produced by the company DU PONT DE NEMOURS and sold under the name TYVEK ®. They are resistant to tearing and to bursting. Moreover, they are supple. They have nevertheless a major drawback which is that their look-through is very heterogeneous, i.e. that the distribution of fibers per surface unit is irregular, consequently that the porosity of the sheet is uneven. For example, in some parts, the sheet may have pores of very large diameter which will allow the micro-organisms inside the package produced with the sheet. In other parts, on the contrary, the sheet may have pores of extremely small diameter, which will hinder the penetration of the molecules of sterilizing gas. Moreover, said sheets are absolutely permanent, i.e. non biodegradable.

SUMMARY OF THE INVENTION

It is the aim of the present invention to overcome the aforesaid drawbacks.

One object of the invention is to provide a sheet which can be used in particular for sterilizable packages, and which has, simultaneously, the following properties:

sufficient suppleness to form packages;

sufficient resistance to tearing and bursting to withstand impacts with heavy and blunt objects;

poor water-absorption;

controlled porosity, namely pores with regular diameters, large enough to allow the passage of gas molecules, yet small enough to prevent the passage of micro-organisms.

Another object of the invention is to provide a printable sheet, preferably by heliographic, offset or flexographic printing.

Indeed, sterilizable packages always contain a reference which may be obtained with inks reacting to sterilization.

Another object of the invention is to provide a sheet whose physical characteristics are homogeneous, namely substantially the same in crosswise and lengthwise direction.

Yet another object of the invention is to provide a sheet which is more readily biodegradable after use and of a competitive price to produce.

Accordingly, the invention relates to a supple sheet which is resistant to tearing and bursting, has a low water- or any other liquid-absorbing power and a controlled porosity, and which is printable.

The invention is remarkable in that, according to anyone skilled in the art, it is difficult to re-group simultaneously all the aforesaid properties. Indeed, the products which improve the mechanical properties normally increase stiffness, consequently reducing suppleness.

In order to improve suppleness, the experts have proposed to add softening agents. But there are two types of softening agents: those reducing the bonds between the fibers and those preserving moisture. (See for reference Pulp and Paper, Volume III, 1981, pages 1763–1764, 3rd issue, published by J. P. Casey).

The first cited softening agents destroy the bonds between the fibers, consequently reducing the mechanical properties. The next cited softening agents do not have this problem but they prevent the action of the sizing agents which confer its blocking properties to the sheet.

The Applicant has overcome the aforesaid prejudice in the art and has unexpectedly found that it is possible to obtain a sheet exhibiting the aforesaid properties by producing a fibrous sheet containing:

at least cellulosic fibers, optionally synthetic fibers, optionally a moisture-resisting agent, at least one binder, at least one moisture-retaining agent in a proportion less than about 20% by dry weight of the sheet, at least one sizing agent.

The invention thus provides a fibrous sheet usable for supple packages comprising at least a base material of cellulosic fibers of which at least one of the faces is impregnated with a composition comprising at least one binder, at least one moisture-retaining agent and at least one sizing agent, said base material being such that the COBB sizing is less than 20 g/m2 and TABER stiffness is less than 2.5. The sheet preferably contains at least 1% of moisture-retaining agent.

The moisture-retaining agent is preferably selected from the group composed of urea, a nitrate salt or the mixtures thereof. A preferred urea-nitrate mixture will be a urea/sodium nitrate mixture with a urea-sodium nitrate ratio of 2:1.

The sizing agent is selected from the group consisting of the wax or paraffin dispersions, alkyl ketene dimeres, succinic alkylene anhydrides, stearic anhydrides and mixtures thereof.

The binder is selected from the group consisting of polyvinyl alcohol, native starch or its derivatives, cellulose ethers or esters, alginates, guranates or mixtures thereof.

The impregnation composition is preferably produced in aqueous medium.

The composition preferably contains:

up to 5% by dry weight of a binder, up to 5% by dry weight of an aqueous paraffin dispersion, up to 20% by dry weight of urea or of a urea-sodium nitrate mixture with respect to the weight of the dry sheet.

The fibrous base material is preferably formed mainly of cellulose fibers. Said base material is preferably non bulk-sized; it can contain at least one moisture-resistant agent. The sheet is produced by a papermaking process. The base medium can be impregnated with the composition according to the invention, using a size press. Any other impregnation or coating means normally used in the papermaking industry are suitable.

The invention is remarkable in that the obtained sheet has a COBB value (index) lower than 20 g/m2 and able to reach 12 g/m2, and a TABER stiffness less than 2.5, with a tearing index higher than 80 cNm2/g.

The sheet obtained according to the invention can be heat-sealed with plastic films. It can be coated with a varnish in aqueous or solvent medium.

It is moreover delaminatable.

It conforms to the norms on sterilizable packages (DIN 58953, B5 6256) and on packages designed to come into contact with foodstuffs (FDA, BGA).

EXAMPLES

The following test examples have been carried out on a laboratory papermaking machine.

A base material containing non bulk-sized cellulose fibers, is impregnated by means of a size press. The compositions for the impregnation bath are produced in aqueous medium.

The properties of the resulting sheets are given in Table I.

The tearing index is measured according to the Norm ISO 1974.

The dry bursting index is measured according to the Norm ISO 2758.

The wet bursting index is measured according to the Norm ISO 3686 (after immersion in water for ten minutes).

The wet strength is the ratio of the wet and dry bursting indices, multiplied by 100.

The TABER stiffness is measured according to the Norm ISO 2493.

The BENDTSEN porosity is measured according to the Norm ISO 5636/3.

The dry taking up expresses the quantity of slip by dry weight absorbed by the sheet per square meter.

The COBB $C_{60}$ value (index) is measured according to the Norm ISO 535 (water, 1 minute, at 23° C.).

TABLE 1

| EXAMPLE | 1 | 2 | 3 | 4 |
|---|---|---|---|---|
| Impregnation bath: | | | | |
| binder: polyvinylic alcohol (% by dry weight/bath) | 1 | 1 | 1 | 1 |
| Sizing agent: Aqueous dispersion of paraffin (% by dry weight/bath) | 2 | 2 | 2 | 2 |
| Moisture-retaining agent: | | | | |
| urea | 20 | 20 | 14 | 14 |
| sodium nitrate | | | 6 | 6 |
| Dry take-up (g/m2) | 13 | 5 | 14 | 7 |
| Gramme per unit surface | 103 | 107 | 105 | 109 |
| Thickness | 113 | 133 | 146 | 135 |
| COBB $C_{60}$ | 12.5 | 12 | 14 | 13 |
| Tearing index | 88 | 99 | 84 | 93 |
| Dry bursting index | 43.5 | 50 | 46 | 51.5 |
| Wet burning index | 15.5 | 21 | 19.5 | 23 |
| REH Bursting | 36 | 42 | 42 | 45 |
| Stiffness | 1.61 | 2.49 | 1.21 | 2.25 |
| BENDTSEN Porosity | 300 | 330 | 350 | 310 |

The resulting sheets are sterilizable. They are also sealable and delaminatable.

The sheets obtained according to Example 1 to 4, were sterilized with steam, ethyl oxide or gamma radiation, then their characteristics were measured.

The results obtained are given in Table 2.

TABLE 2

| EXAMPLE | 1 | 2 | 3 | 4 |
|---|---|---|---|---|
| Gramme per unit surface | | | | |
| Steam | 104 | 112 | — | 105 |
| Ethylene oxide | 104 | 112 | 106 | 106 |
| Gamma radiations | 103 | 111 | 104 | 106 |
| Bursting index | | | | |
| Steam | 91 | 109 | — | 97 |
| Ethylene oxide | 88 | 106 | 89 | 96 |
| Gamma radiations | 65 | 62 | 62 | 67 |
| Dry bursting index | | | | |
| Steam | 42 | 45 | — | 31 |
| Ethylene oxide | 47 | 50 | 48 | 34 |
| Gamma radiations | 36 | 38 | 41 | 25 |
| Wet burning index | | | | |
| Steam | 12 | 10 | | 15.5 |
| Ethylene oxide | 16 | 20 | 23 | 22 |
| Gamma radiations | 11 | 13.5 | 16.5 | 17 |
| REH bursting | | | | |
| Steam | 29 | 39 | — | 34 |
| Ethylene oxide | 34 | 44 | 43 | 45 |
| Gamma radiations | 31 | 40 | 42 | 40 |
| TABER Stiffness | | | | |
| Steam | 1.25 | 2.19 | — | 2.09 |
| Ethylene oxide | 1.70 | 2.50 | 1.27 | 2.11 |
| Gamma radiations | 1.71 | 2.37 | 1.11 | 2.22 |
| BENDTSEN Porosity | | | | |
| Steam | 605 | 350 | — | 340 |
| Ethylene oxide | 310 | 330 | 360 | 330 |
| Gamma radiations | 340 | 340 | 360 | 325 |

COMPARATIVE EXAMPLES

The paper is coated with an aqueous composition containing sorbitol and dimer ketene. Cobb is measured. Table 3 shows that the sizing is much easier to obtain with the composition containing urea and/or nitrate salt according to the invention.

TABLE 3

| COMPOSITION | | | | | | | | | | |
|---|---|---|---|---|---|---|---|---|---|---|
| PV alcohol | | | | | | | | 1% | 1% | 1% |
| Sorbitol | 58% | 58% | 58% | | | | | | | |
| Urea | | | | 13% | 16% | 14% | 23% | 16% | 20% | 23% |
| Nitrate | | | | 7% | 8% | 7% | | 8% | | |
| Dimer ketene | 3% | 10% | 3% | 3% | | 6% | | | 3% | |
| Paraffin | | | 9% | | 5% | | 5% | 5% | | 5% |
| Overall dry take-up | 23% | 29% | 18% | 14% | 15% | 15% | 15% | 13% | 14% | 15% |
| Cobb 1 min. | 32 | 55 | 22 | 23 | 15 | 23 | 14 | 14 | 23 | 13 |

What is claimed is:

1. A supple biodegradable sheet, resistant to tearing and bursting, with poor water or other liquid-absorbing power, having a controlled porosity, namely pores with regular diameters, large enough to allow the passage of gas molecules, yet small enough to prevent the passage of microorganisms and being printable and having homogeneous physical characteristics in the crosswise and lengthwise directions, wherein said sheet comprises:

at least cellulosic fibers, optionally synthetic fibers, optionally a moisture-resisting agent;

at least one binder, at least one moisture-retaining agent in a proportion less than about 20% by dry weight of the sheet, at least one sizing agent, wherein the sheet has a COBB sizing value which is less than 20 g/m$^2$ and the TABER stiffness is less than 2.5.

2. Sheet as claimed in claim 1, wherein said sheet contains at least 1% of moisture-retaining agent.

3. Sheet as claimed in claim 1, wherein said moisture-retaining agent is urea, a nitrate salt or mixtures thereof.

4. Sheet as claimed in claim 1, wherein said moisture-retaining agent is a urea/sodium nitrate mixture in a ratio of 2:1.

5. Sheet as claimed in claim 1, wherein the sizing agent is selected from the group consisting of wax or paraffin dispersions, alkylketene dimers, succinic alkylene anhydrides, stearic anhydrides and mixtures thereof.

6. Sheet as claimed in claim 1, wherein the binder is selected from the group consisting of polyvinyl alcohol, native starch or its derivatives, cellulose ethers or esters, alginates, guaranates or mixtures thereof.

7. Sterilizable package, wherein said package comprises at least one sheet as claimed in claim 1.

* * * * *